United States Patent [19]

Payne

[11] Patent Number: 4,727,460

[45] Date of Patent: Feb. 23, 1988

[54] ADJUSTABLE LIGHTING FIXTURE

[75] Inventor: Gary L. Payne, New York, N.Y.

[73] Assignee: Lazin Lighting Inc., New York, N.Y.

[21] Appl. No.: 862,845

[22] Filed: May 13, 1986

[51] Int. Cl.[4] ..... F21V 21/26

[52] U.S. Cl. ..... 362/269; 362/275; 362/371; 362/287; 248/286

[58] Field of Search ..... 362/272, 368, 396, 422, 362/404, 430, 269, 804, 275, 285, 287, 370, 371, 418, 419; 248/229, 286 X; 403/61, 80

[56] References Cited

U.S. PATENT DOCUMENTS

| | | | |
|---|---|---|---|
| 2,967,230 | 11/1961 | Goetz et al. | 362/269 |
| 3,086,107 | 4/1963 | Grover | 362/371 |
| 3,748,463 | 7/1973 | Trassinelli | 362/269 |
| 4,380,792 | 4/1983 | Terrell | 362/275 |
| 4,566,058 | 11/1986 | Barnett | 362/404 |
| 4,591,953 | 5/1986 | Oram | 362/275 |

FOREIGN PATENT DOCUMENTS

| | | | |
|---|---|---|---|
| 707828 | 4/1954 | United Kingdom | 362/362 |

OTHER PUBLICATIONS

Drawing Number C57L23 of Morgan Payne Associates "Grip 36 Assembly Plan 1".

*Primary Examiner*—William A. Cuchlinski, Jr.

*Assistant Examiner*—D. M. Cox

*Attorney, Agent, or Firm*—Panitch, Schwarze, Jacobs and Nadel

[57] ABSTRACT

An adjustable fixture for holding a lamp of the type having a generally annular rim, such as a sealed-beam lamp, includes a lampholder having front and rear generally parallel, spaced generally U-shaped members. The lampholder includes a base section adapted to engage the lamp proximate the rim and a pair of generally straight sections. Spring clips are preferably positioned on the straight sections of at least one of the U-shaped members for biasing the lamp toward the base sections of the U-shaped member. An elongated bridging member extends between the straight sections of the U-shaped members for interconnecting the straight sections. At least one end of the bridging member having a generally flat surface. A support arm member having a surface adapted for engagement with the generally flat surface of the bridging member is removably secured to the bridging arm member. The support arm member is also adapted to be secured to a fixed structure utilizing a fixture mount. Preferably, lamp retaining pins extend inwardly from the base section of the rear U-shaped member. The base section of the front U-shaped member is preferably split to permit the front U-shaped member to be spread for lamp installation.

20 Claims, 6 Drawing Figures

ADJUSTABLE LIGHTING FIXTURE

BACKGROUND OF THE INVENTION

The present invention relates generally to lighting fixtures, and in particular to adjustable fixtures for holding lamps of the type having a generally annular rim, such as a sealed-beam lamp.

Lamps having an annular rim, for example floodlamps and general include a front lens and a rear internal reflector. Also known as sealed-beam and reflector lamps, they are available in low voltage models, such as 12 volt models, and in high voltage models, such as models adapted for line voltage (for example 120 volts). The lamps are available in a variety of beam spreads, wattages, and shapes. Fixtures are available for mounting the lamps on lighting tracks, or directly in fixed or movable orientations in or on surfaces such as walls and ceilings, and the like.

The beams of track-mounted lamps may often be quickly and easily redirectd as desired by adjusting the position of individual track lighting fixtures along the lighting track. This flexibility may be provided by a track adapter which secures the lamp-containing fixture to the lighting track. In addition to the flexibility provided by the ability to translate the lighting fixture along the lighting track, it is desirable to provide the lighting fixture with additional degrees of freedom to achieve desired lighting effects. For example, it is desirable to be able to rotate the lamp in the fixture about a vertical axis to redirect the beam of the lamp. Similarly, it is desirable to be able to rotate the lamp in the fixture about an axis parallel to the plane of the lighting track. Further, it is desirable that the lighting fixture provide these degrees of freedom without requiring special tools for positioning or securing the fixture when changing the orientation of the lamp beam.

The present invention provides a fixture for securely holding lamps of the type having a generally annular rim, such as sealed-beam lamps, including spot lamps and flood lamps. The present invention permits the orientation of the lamp beam to be quickly and easily varied without requiring the use of special tools. The present invention also securely holds the lamp while permitting quick and simple replacement of lamps.

SUMMARY OF THE INVENTION

Briefly stated, the present invention comprises an adjustable fixture for holding a lamp of the type having a rim such as a generally annular rim. The fixture includes a lampholder having a front and a rear generally U-shaped member. The U-shaped members are spaced from one another and are generally parallel. Each U-shaped member includes a base section adapted to engage the lamp proximate the rim thereof and a pair of generally parallel straight sections. One of the straight sections extends from each end of the base section. When the lamp has a generally circular rim, it is preferred that the base sections of the U-shaped members be semicircular.

The fixture includes biasing means positioned on a straight section of at least one of the U-shaped members for biasing the lamp toward the base sections of the lampholder. An elongated bridging member extends between the straight sections of each of the U-shaped members for interconnecting the straight sections. At least one end of the bridging member has a generally flat surface.

The fixture additionally includes a support arm member having a surface adapted for engagement with a generally flat surface of the bridging member. The support arm member also has an end adapted to be secured to a fixture mounting means. The fixture further includes means for removably securing the bridging member to the support arm member.

In one presently preferred embodiment of the invention, the support arm member has a pair of parallel generally flat surfaces and an aperture extending therebetween. In this embodiment the attachment means for removably securing the bridging member to the support arm member includes a generally cylindrical first bore of a first predetermined diameter in the end of a bridging member having a flat surface. A threaded generally cylindrical second bore is provided concentric with the first bore. The second bore has a smaller diameter than the first bore and extends into the bridging member from the first bore.

The attachment means further includes a knob member having a body adapted to be gripped by an operator and a generally cylindrical sleeve extending from the body. The sleeve has an outer diameter substantially the same as the first predetermined diameter. The body has a generally flat surface proximate the sleeve and extending perpendicularly thereto. The knob member also has a threaded section coaxial with and extending beyond the sleeve.

The sleeve is positioned in the aperture of the support arm member. When the threaded section of the knob member is rotatably received within the threaded second bore of the bridging member, the knob member is at the same time rotatably received within the first bore of the bridging member. The support arm member thus extends between the flat surface at the end of the bridging member having the bores and the flat surface of the knob member proximate the sleeve. Thus, inward rotation of the knob member secures the bridging member to the support arm member.

Preferably the base section of at least one of the U-shaped members is split to permit the U-shaped member to be spread outwardly for installation of a lamp in the lampholder. Further, it is preferred that the base section of the rear U-shaped member contain at least two lamp retention members extending therefrom for engaging a lamp mounted in the fixture. It is also preferred that the biasing means comprise spring clips wherein each of the spring clips extends from the straight section of the front U-shaped member to the respective straight section of the rear U-shaped member.

BRIEF DESCRIPTION OF THE DRAWINGS

The foregoing summary as well as the following detailed description of a presently preferred embodiment of the invention will be better understood when read in conjunction with the appended drawings. It is understood, however, that this invention is not limited to the precise arrangements illustrated. In the drawings.

DETAILED DESCRIPTION OF THE PREFFERED EMBODIMENT

Figure 1:
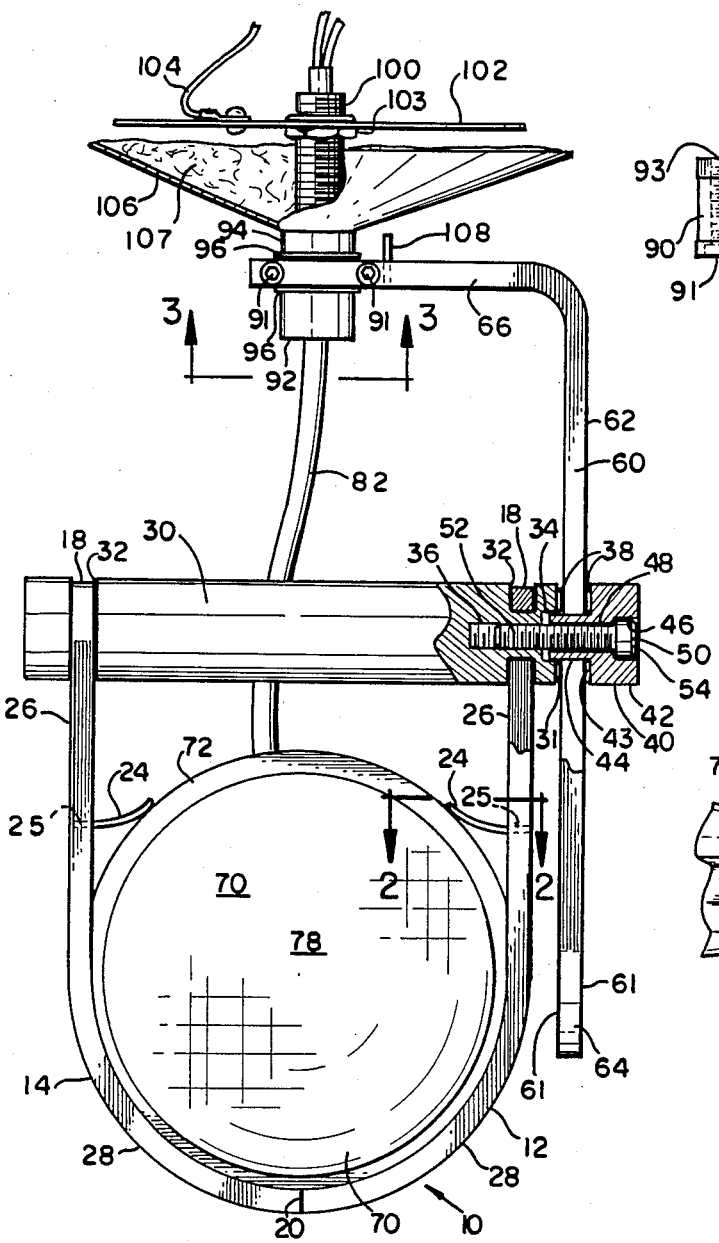
FIG. 1 is a partially sectional, front elevational view of a fixture in accordance with a presently preferred embodiment of the present invention, showing the fixture adapted to mount a lamp on a surface such as a ceiling.

Referring in detail to the drawings, wherein like numerals indicate like elements throughout the several figures, there is shown in FIG. 1 a partially sectional, front elevational view of an adjustable lighting sconce or fixture 10 in accordance with the present invention. The fixture 10 includes a lampholder 12 which is adapted to securely engage a lamp 70 proximate the rim 72 of the lamp 70, an elongated bridging member 30, and a support arm member or support arm 60.

The individual components of the fixture 10 may be made from any material known in the art which will securely hold the lamp at the operational temperature of the lamp. Preferably, the components of the fixture 10 are made from a material which does not deform or expand excessively as a result of heat generated by the lamp during operation. Thus, the components of the fixture 10 may be made from a metal or metal alloy such as steel, aluminum, brass, bronze, copper, monel metal, nickel, or the like. A component of the fixture 10 which is made from a metal may have a surface which is plated with another metal, such as zinc, tin, nickel, or the like, or coated with a material such as an enamel, to increase the attractiveness or corrosion resistance of the fixture 10. Plastic materials which do not deform excessively at the operational temperature of the lamp may also be used to form components of the fixture 10. Preferably, plastic materials used to form components of the fixture 10 have low flammability.

Lamps which may be mounted in the fixture 10 of the present invention include sealed-beam spotlamps, floodlamps and lamps of other types such as PAR-36 and MR-16 lamps. Sealed-beam lamps are constructed by fusing together a glass reflector having an interior surface coated with a reflective coating and a glass cover or lens. The fused peripheries of the lens and reflector result in a lamp with a generally annular rim 72. The lamp may have a lens which is generally circular, generally rectangular, generally square, or the like. The lamp may be of relatively high voltage type, such as a flood lamp or spot lamp adapted to be illuminated by line voltage, such as 120 volt alternating current, and the like. Alternatively, the lamp may be a type which is adapted to be illuminated by a relatively low voltage, such as 12 volt direct or alternating current, and the like. For example, PAR 36 lamps may be used.

As illustrated in FIG. 1, the fixture 10 may be adapted to be permanently mounted on a fixed structure or surface, such as a ceiling or a wall surface (not shown). Alternatively, as illustrated in FIG. 4, the fixture 10 may be adapted to be mounted on a standard lighting track 120 by a standard track adapter 110, so that the position of the fixture 10 along the track 120 may be easily and quickly varied in a manner known in the art.

Figure 4:
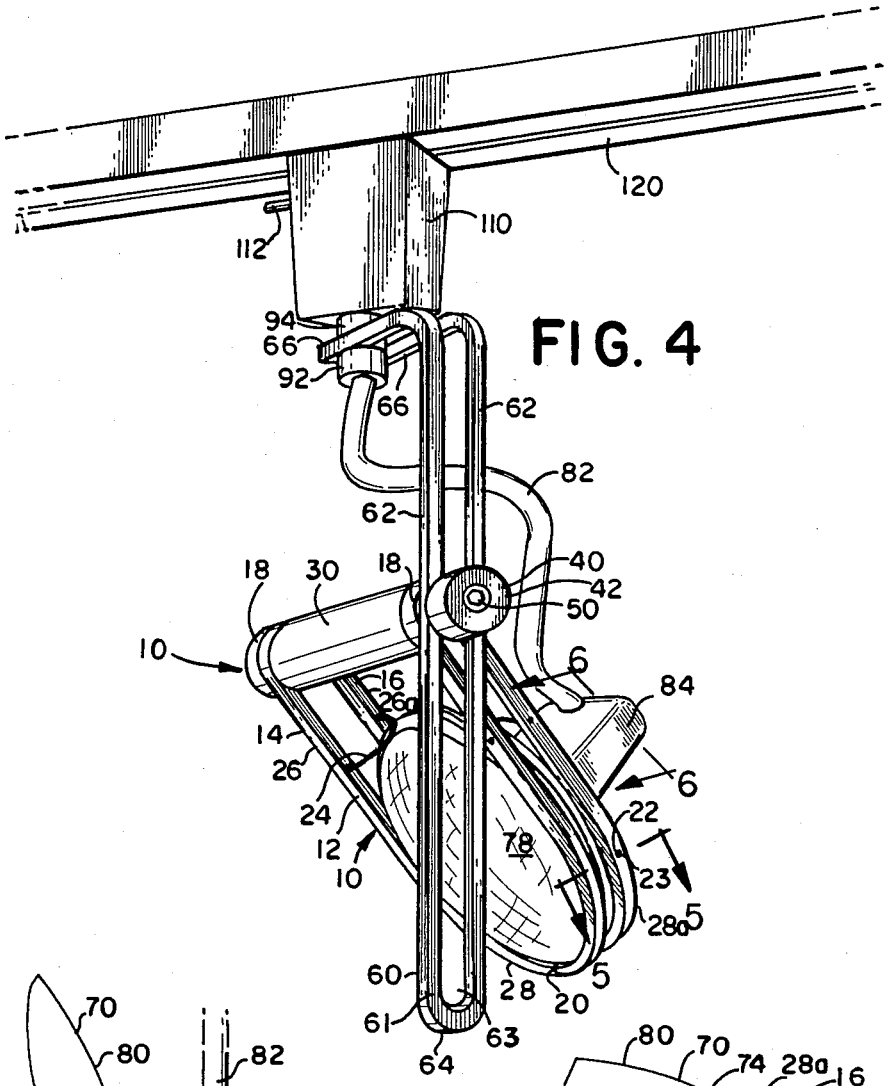
FIG. 4 is a perspective view of the fixture shown in FIGS. 1-3 but adapted for mounting a lamp on a lighting track.

Referring now to FIG. 4, it can be seen that the fixture 10 comprises a lampholder 12 which includes a front generally U-shaped member 14 and a rear generally U-shaped member 16. The front and rear U-shaped members 14, 16 are generally parallel and spaced apart from one another by a predetermined distance which is about the same as or slightly greater than the thickness of the rim 72 of the lamp 70. Both the front and the rear U-shaped members 14, 16 include a base section 28, 28*a* respectively adapted to engage and hold the lamp 70 proximate the rim 72 thereof, and a pair of generally straight sections 26, 26*a* which respectively extend from each end of the base sections 28, 28*a*.

When the lamp 70 has a generally circular rim 72, as illustrated in FIG. 4, it is preferred that the base sections 28, 28*a* of the front and rear U-shaped members 14, 16 be generally semicircular. Similarly, when the lamp 70 has a rim 72 which is generally rectangular (not illustrated), it is preferred that the base sections 28, 28*a* of the front and rear U-shaped members 14, 16 be generally straight. In general, it is preferred the base sections 28, 28*a* parallel and confront the rim 72 of the lamp 70 when the lamp 70 is installed in the lampholder as shown in the figures.

Figure 2:
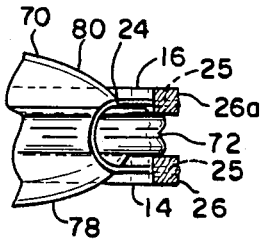
FIG. 2 is a partial sectional view of the fixture taken along lines 2—2 of FIG. 1.

Preferably, biasing means are positioned on the straight section 26, 26*a* of at least one of the U-shaped members 14, 16 for biasing the lamp 70 towards the base sections 28, 28*a* of the U-shaped members. The biasing means in the present embodiment are preferably spring clips 24 which are fabricated of a resiliant material such as spring steel and are retained within suitably sized openings or bores 25 in the straight sections 26, 26*a* of the front and rear U-shaped members 14, 16. As best seen in FIG. 2, each of the generally U-shaped spring clips 24 extends from the straight section 26 of the front U-shaped member 14 to the respective straight section 26*a* of the rear U-shaped member 16. As best seen in FIGS. 1 and 4, when the lamp 70 is contained within the fixture 10, the spring clips 24 press against the annular rim 72 of the lamp 70 to securely retain the rim 72 of the lamp 70 within the space between the two base sections 28, 28*a* of the U-shaped members 14, 16.

Preferably, the base section of at least one of the U-shaped members 14, 16 is split crosswise to permit the U-shaped member to be spread outwardly to facilitate installation of the lamp 70 into the lampholder 12. As best seen in FIG. 1, in the presently preferred embodiment, the split 20 is centered in the semicircular base section 28 of the front U-shaped member 14.

Figure 5:
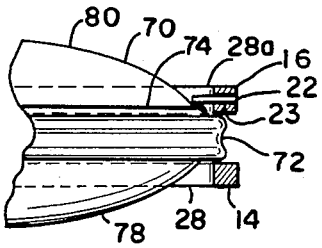
FIG. 5 is a partial sectional view of the fixture taken along lines 5—5 of FIG. 4.

Referring now to FIGS. 4 and 5, it is preferred that the base section 28*a* of the rear U-shaped member 16 contain at least one lamp retention member for engaging the lamp 70 and for limiting rearward movement of its lower end. In the presently preferred embodiment, two lamp retention members comprised of pins 22 extending inwardly in the plane of the rear U-shaped member 16 and are mounted in suitably sized openings or bores 23 formed in the base section 28*a* of the rear U-shaped member 16. As shown in FIG. 5, the pins 22 form a rear mounting surface and preferably are located and sized to contact the rear surface of a raised rear bead 74 frequently formed in lamps such as PAR-36 and similar lamps. The pins 22 limit the rearward movement of the lamp 70 within the lampholder 12. In alternative embodiments (not illustrated), the lamp retention member or members may be an inwardly projecting ridge formed on the rear U-shaped member, a plurality of inwardly projecting tabs formed on the rear U-shaped member, or the like.

A lamp 70 may be inserted in the lampholder 12 of the present embodiment by spreading the front U-shaped member 14 and positioning the lamp 70 so that rear bead 74 contacts the pins 22. Subsequently, the front U-shaped member 14 may be released and allowed to retract. The top portion of the lamp 70 is next pressed against the spring clips 24 until the rim 72 of the lamp 70 is centered between the front and rear U-shaped members 14, 16.

As shown in FIGS. 1 and 4, an elongated bridging member 30 extends between the straight sections **26, 26*a* of the front and rear U-shaped members 14, 16 for interconnecting the four straight sections 26, 26*a*. The bridging member 30** may be generally cylindrical, as in the present embodiment. However, the bridging member may assume other shapes; for example, the bridging member may be square or rectangular in cross-section (not illustrated).

In the present embodiment the lampholder 12 includes a pair of semicircular loops 18 which extend perpendicularly with respect to the U-shaped members 14, 16 and which are formed integrally therewith to interconnect the distal ends of the straight sections **26, 26*a* of the two U-shaped members 14, 16. The loops 18 secure the lampholder 12 to the bridging member 30. As best seen in FIG. 1, in the present embodiment the generally cylindrical bridging member 30 includes a pair of spaced, generally annular recesses 32 of substantially the same depth as the thickness of the loops 18 for securely receiving the loops 18 of the lampholder 12. The loops 18 may be press fit into the recesses 32 in the bridging member 30. Alternatively, the loops 18** may be secured to the bridging member by mechanical means, such as by screws, bolts, rivets or the like, or by adhesive means, by welding, or the like (not illustrated).

The lampholder 12 of the present embodiment may be advantageously formed from a single piece of stock material by a sequence of bending operations or by a single casting, as will be apparent to those skilled in the art. Alternatively, the front and rear U-shaped members 14, 16 of the lampholder 12 may be formed separately and subsequently securely attached to the bridging member 30 (not illustrated). In another alternative (not shown), the bridging member 30 and the front and rear U-shaped members 14, 16 are formed integrally.

The bridging member 30 has at least one end having a generally flat surface 31. In the present embodiment, the other end of the generally cylindrical bridging member 30 also has a generally flat surface. As shown in FIG. 1, the bridging member 30 also includes a generally cylindrical first bore or counterbore 34 in the flat surface 31 of the one end. The first bore is of a first predetermined diameter and extends generally axially along the bridging member 30 and generally perpendicularly with respect to the straight sections **26, 26*a* of the U-shaped members 14, 16. The bridging member 30 further includes a threaded, generally cylindrical second bore or opening 36 which is concentric with the first bore 34. The second bore 36 has a smaller diameter than the first bore 34 and extends into the bridging member 30 from the first bore 34, as illustrated in FIG. 1**, for a purpose described below.

As best seen in FIG. 4, the fixture 10 of the present embodiment further includes a support arm or support arm member 60 having a pair of parallel generally flat surfaces 61 and an aperture 63 extending therebetween. The width of the aperture 63 is substantially the same as but not less than the first predetermined diameter. The aperture 63 may be an elongated slot-like aperture as illustrated in FIG. 4. Alternatively, the support arm 60 may include a plurality of individual, spaced apertures (not illustrated) as further discussed below. In the present embodiment, the support arm 60 includes a pair of spaced, generally parallel L-shaped bars including generally vertically extending bars 62 and generally horizontal extending bars 66, each horizontal bar 66 being formed integrally with each respective vertical bar 62. The vertical bars 62 are spaced apart by a distance which is less than the greatest dimension of the flat surface 31 at the one end of the bridging member 30. The support arm 60 further includes a curved or semicircular section 64 interconnecting and formed integrally with the vertical bars 62. Thus, in this embodiment the aperture 63 comprises the space between the vertical bars 62. The support arm 60, like the lampholder 12, may be advantageously formed using a single piece of stock in a sequence of bending operations or by a single casting.

As best seen in FIG. 1, fixture 10 further preferably includes a knob member or knob 40 which has a body 42 adapted to be gripped by hand. For example, the body 40 may have knurled exterior surface or the like (not shown), to facilitate a firm grip on the knob 40 for tightening and releasing it. Alternatively, the knob may be in the shape of a wing nut, thumb screw or the like.

The knob 40 has a generally cylindrical sleeve 44 extending from the body 42. The sleeve 44 has an outer diameter substantially equal to the first predetermined diameter so that it is adapted to be snugly but rotatably received within the first bore 34 of the bridging member 30. As best seen in FIG. 4, the body 42 may also be generally cylindrical. The body 42 has a generally flat surface or shoulder 43 proximate the sleeve 44 and extending perpendicularly thereto. Preferably, the greatest dimension of the flat surface 43 of the body 42 is approximately the same as the greatest dimension of the flat surface 31 at the one end of the bridging member 30.

The knob 40 also includes a threaded section coaxial with the sleeve 44 and extending beyond the sleeve 44. The threaded section is adapted to be rotatably received by the threaded second bore 36 of the bridging member 30. In the present embodiment, best seen in FIG. 1, the threaded section 52 of the knob 40 is comprised by a threaded bolt member or bolt 50. The knob 40 has a generally cylindrical first bore or counterbore 46 formed in the body 42 opposite to and coaxial with the sleeve 44. In addition, the knob 40 has a threaded generally cylindrical second bore 48 formed coaxially with the first bore 46. The second bore 48 has smaller diameter than the first bore 46. The second bore 48 extends from the first bore 46 through the body 42 and sleeve 44.

In the present embodiment the threaded bolt 50 has a head 54 and a threaded section 52 adapted to be received by the first and second bores 46, 48 of the knob 40 respectively. The bolt 50 is non-rotatably secured within the knob member 40 by, for example, anaerobically curable adhesive.

In assembling the fixture 10 the bolt 50 is inserted into the first bore 46 of the knob 40. The bolt 50 is then screwed into the threaded second bore 48 of the knob 40 until only the head 54 and a portion of the threaded section 52 of the bolt 50 protrude from the knob 40 proximate the first bore 46. A small amount of anaerobically curably adhesive is then placed on the exposed portion of the threaded section 52 and the bolt is screwed in further so that the portion of the threaded section 52 coated with anaerobically curable adhesive bridges the confronting threads of the bolt 50 and the second bore 48 of the knob 40. Alternatively, the threaded section may be formed integrally with the sleeve 44 of the knob 40 (not illustrated).

When the adhesive has cured, the knob 40 is used to secure the support arm 60 to the bridging member 30. The sleeve 44 is inserted through the aperture or slot 63 in the support arm 60 and the threaded section 52 of the knob 40 is inserted through the first bore 34 and into the second bore 36 of the bridging member 30. As the threaded section 52 is screwed into the second bore 36, the sleeve 44 enters the first bore 34 of the bridging member 30. The outside generally cylindrical surface of the sleeve 44 confronts the interior generally cylindrical surface of the first bore 34. The knob 50 is tightened until the flat surfaces 31, 43 of the bridging member 30 and the knob 40 contact the confronting flat surfaces 61 on either side of the support arm 60, or as described below, interposed washers.

Preferably, washers 38, preferably of the friction-reducing type, are positioned on the sleeve 44 on either side of the support arm 60. The washers 38 may be formed from a synthetic or natural polymeric material, such as nylon, polytetrafluoroethylene, polyolefin, or the like. The washers are preferably selected to have smooth, friction-reducing surfaces. In addition, a lock washer (not shown) may be interposed between one of the washers 38 and one of the flat surfaces 31, 43 on the bridging member 30 and the knob 40 respectively. The friction-reducing washers and lock washer aid in providing a means for easily but securely locking the bridging member 30 in a desired position with respect to the support arm 60 and for readily releasing the bridging member 30 from the support arm 60 to adjust the position of the lamp 70 when desired.

Thus, the position of the lamp 70 about the common axis of the bridging member 30 and knob 40 may be easily varied by first slightly loosening the knob 50 by rotating it outward, next adjusting the orientation of the lamp 70 about the common axis as desired, and subsequently retightening the knob 40 to securely fix the desired orientation. In the present embodiment, the height of the lamp 70 and the vertical position of the bridging member 30 with respect to the support arm 60 may also be varied by first loosening the knob 50, next raising or lowering the bridging member 30 until the desired height is obtained, and subsequently tightening the knob 40. The orientation and vertical position of the lamp may also be varied simultaneously in a similar manner.

In an alternative embodiment (not illustrated) the support arm member is provided with a plurality of spaced openings which are adapted to receive the sleeve 44 of the knob 40. In this alternative embodiment, the knob 40 must be completely withdrawn from the bridging member 30 before the vertical position of the bridging member 30 can be altered.

Figure 3:
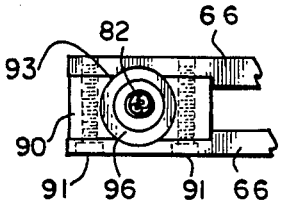
FIG. 3 is a partial sectional view of the fixture taken along lines 3—3 of FIG. 1.

In the present invention, the upper or distal end of the support arm member 60 is adapted to be secured to a fixture mounting means. In the illustrated embodiment the distal ends of the horizontal bars 66 of the support arm 60 are spaced by a mounting block 90, as shown in the partial sectional view of FIG. 3. A pair of bolts 91 extend through and secure together the horizontal bars 66 and the mounting block 90. A generally cylindrical aperture 93 extends perpendicularly through the mounting block 90. The mounting block 90 and aperture 93 are preferably centered above the lampholder 12 so that the center of gravity of the fixture 10 is directly below the aperture 93 when the fixture 10 is mounted on a horizontal surface such as a ceiling.

As best seen in FIG. 1, in the present embodiment the support arm 60 is positioned between a generally cylindrical upper nut 94 having a threaded, generally cylindrical interior surface, and a generally cylindrical base nut 92, also having a threaded generally cylindrical interior surface.

As shown in FIG. 1, a standard lighting fixture mounting nipple or sleeve 100, having a generally cylindrical interior bore and a generally cylindrical exterior surface having threads adapted to be engaged by the interior threads of the upper and base nuts 92, 94, may be employed to mount the fixture 10 in a horizontal surface such as a ceiling (not shown). Preferably, a pair of friction reducing washers 96 are positioned on the nipple 100, one between the base surface of the upper nut 94 and the support arm 60 and one between the upper surface of the base nut 92 and the support arm 60. The relative position of the base nut 92 and the upper nut 94 on the nipple 100 is adjusted until the support arm 60 is securely but rotatably engaged by the washers 96. When properly adjusted, the fixture 10 may be easily but securely rotated about the axis of the nipple 100. The nipple 100 may be affixed to a mounting plate 102 using hex nuts in a conventional fashion. Preferably, the mounting plate is grounded electrically through a ground wire 104. The exposed portion of the nipple 100 extending below the horizontal mounting surface (not illustrated) may be hidden with a cover 106 which may be filled with an insulating material 107.

As illustrated in FIG. 1 electrical power may be supplied to the lamp 70 through a cable 82 which extends through the nipple 100 from a source of electric current (not shown). In order to prevent the fixture 10 from being rotated by more than 360 degrees around the vertical axis of the fixture 10, a pin 108 may be provided in one of the horizontal bars 66 of the support arm 60. The pin 108 limits rotation by contacting a tab or pin projecting from the cover 106 (not shown), thus preventing the cable 82 from being twisted from excessive rotation of the fixture 10.

Figure 6:
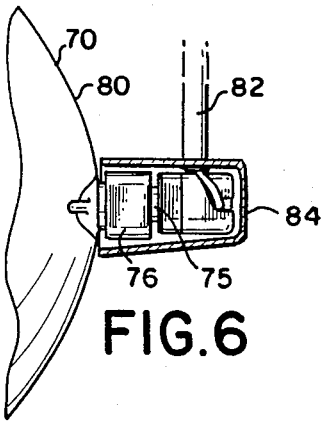
FIG. 6 is partial sectional view of the fixture taken along lines 6—6 of FIG. 4.

Referring now to FIG. 4, it can be seen that in the present embodiment the fixture 10 can also be mounted on an adapter 110 having an adjustment lever 112, which in turn engages a lighting track 120, such as single or multiple circuit LYTESPAN (registered trademark of Lightolier, Inc.) track. The cable 82 terminates in an electrical connector 84. As shown in the partial sectional view of FIG. 6, the electrical connector 84 is adapted to connect the electrical conductors (not illustrated) within the cable 82 to the prongs or terminals 75 projecting from the rear of the reflector 80 of the lamp 70. Typically, the prongs 75 are separated by a ceramic insulator 76 as shown in FIG. 6.

From the foregoing description, it can be seen that the present invention comprises a fixture for securely holding a lamp such a sealed-beam lamp, and which permits the beam of the lamp to be easily and quickly reoriented as desired. It will be recognized by those skilled in the art that changes may be made to the above-described embodiment of the invention without departing from the broad inventive concepts thereof. For example, the rear U-shaped member may be split to permit insertion of the lamp. As another example, a glare reducing skirt may project forward from the front U-shaped member or a lamp-protecting housing may project rearward from the rear U-shaped member. It is understood, therefore, that this invention is not limited to the particular embodiment disclosed but is intended to cover modifications which are within the scope and spirit of the invention as defined by the appended claims.

I claim:

1. An adjustable fixture for holding a lamp of the type having a rim, the fixture comprising:

a lampholder including front and rear generally parallel, spaced, generally U-shaped members, each member including a base section adapted to engage and hold the lamp proximate the rim thereof, and a pair of generally straight parallel sections extending from each end of the base section;

an elongated bridging member extending between the straight sections of each of the U-shaped members for interconnecting the straight sections, the bridging member having at least one end having a generally flat surface, and including a generally cylindrical first bore of a first predetermined diameter in the one end and a threaded, generally cylindrical second bore concentric with the first bore, the second bore having a smaller diameter than the first bore, and extending into the bridging member from the first bore;

a support arm member having at least one generally flat surface and at least one aperture sized not substantially less than the first predetermined diameter extending therethrough; and a knob member having a body adapted to be gripped by an operator, and a generally cylindrical sleeve extending from the body, the sleeve having an outer diameter substantially the same as the first predetermined diameter, the body having a generally flat surface proximate the sleeve and extending perpendicularly thereto, the knob member also having a threaded section coaxial with and extending beyond the sleeve, the threaded section of the knob member being rotatably received within the threaded second bore of the bridging member, the sleeve being rotatably received within the first bore of the bridging member and the support arm member aperture so the support arm member is between the one end of the bridging member and the flat surface of the knob member;

whereby inward rotation of the knob member secures the bridging member to the support arm member.

2. A fixture according to claim 1 wherein the threaded section of the knob member is comprised of a threaded bolt member, the knob member also having a generally cylindrical first bore formed in the body opposite to and coaxial with the sleeve, and a threaded generally cylindrical second bore coaxial with the first bore, having a smaller diameter than the first bore, and extending from the first bore through the body and sleeve, the threaded bolt member having a head and a threaded section adapted to be received by the first and second bores of the knob member respectively, the bolt member being non-rotatably secured within the knob member.

3. A fixture according to claim 1 wherein the base sections of the U-shaped members are generally semicircular.

4. A fixture according to claim 1 wherein the lampholder further comprises a pair of semicircular loops extending perpendicularly with respect to the U-shaped members and formed integrally therewith, the loops securing the lampholder to the bridging member.

5. A fixture according to claim 4 wherein the bridging member includes a pair of spaced generally annular recesses for securely receiving the loops of the lampholder.

6. A fixture according to claim 2 wherein the base section of the rear U-shaped member contains at least one lamp retention member for engaging the lamp.

7. A fixture according to claim 1 additionally comprising a pair of lamp biasing means, each biasing means located on the straight section of at least one of the U-shaped members for biasing the lamp toward the base sections of the U-shaped members.

8. A fixture according to claim 1 wherein the bridging member is generally cylindrical.

9. A fixture according to claim 1 wherein the base section of at least one of the U-shaped members is split to permit the U-shaped member to be spread outwardly for installation of a lamp.

10. A fixture according to claim 9 wherein the front U-shaped member is split.

11. A fixture according to claim 2 further including a pair of washers, one washer being positioned on the bolt member on either side of the support arm member.

12. A fixture according to claim 1 further comprising means for rotatably mounting the support arm member to a fixed structure.

13. A fixture according to claim 1 wherein the support arm member includes a pair of spaced, generally parallel L-shaped bars spaced by a distance which is less than the greatest dimension of the flat surface at the one end of the bridging member and which is at least as great as the first predetermined diameter.

14. A fixture according to claim 13 wherein the support arm member further comprises a semicircular section connecting and formed integrally with at least one end of the L-shaped bars.

15. An adjustable fixture for holding a lamp of the type having a rim, the fixture comprising:

a lampholder having front and rear generally parallel, spaced, generally U-shaped members, each U-shaped member including a base section adapted to engage the lamp proximate the rim thereof and a pair of generally parallel straight sections, one of the straight sections extending from each end of the base section;

biasing means positioned on the straight section of at least one of the U-shaped members for biasing the lamp toward the base sections;

an elongated bridging member extending between the straight sections of each of the U-shaped members for interconnecting the straight sections, at least one end of the bridging member having a generally flat surface;

a support arm member having a surface adapted for engagement with the generally flat surface of the bridging member and having one end adapted to be secured to a fixture mounting means; and attachment means for removably securing the bridging member to the support arm member.

16. A fixture according to claim 15 wherein the base sections of the U-shaped members are generally semicircular.

17. A fixture according to claim 16 wherein the semicircular section of the rear U-shaped member contains at least two lamp retention members extending therefrom for engaging the lamp mounted in the fixture.

18. A fixture according to claim 17 wherein the lamp retention members comprise pins extending inwardly in the plane of the rear U-shaped member, and whereby the pins contact the lamp when a lamp is positioned within the lampholder.

19. A fixture according to claim 15 wherein the biasing means comprise a pair of spring clips, each of the spring clips extending from the straight section of the front U-shaped member to the respective straight section of the rear U-shaped member.

20. A fixture according to claim 16 wherein the semicircular section of the front U-shaped member is split to permit the front U-shaped member to be spread outwardly to permit installation of a lamp.

* * * * *